US005636938A

United States Patent [19]

Ragazzo

[11] Patent Number: 5,636,938

[45] Date of Patent: Jun. 10, 1997

[54] GABION SYSTEM

[76] Inventor: George Ragazzo, P.O. Box 160667, Mobile, Ala. 36616

[21] Appl. No.: 259,908

[22] Filed: Jun. 15, 1994

[51] Int. Cl.[6] ..... E02B 3/12

[52] U.S. Cl. ..... 405/15; 405/21

[58] Field of Search ..... 405/15, 16, 17, 405/21, 272, 284, 258

[56] References Cited

U.S. PATENT DOCUMENTS

| | | | |
|---|---|---|---|
| 855,584 | 6/1907 | Neale | 405/16 |
| 1,165,194 | 12/1915 | Maccaferri | 405/16 |
| 1,873,496 | 8/1932 | Snyder | 405/16 |
| 3,925,994 | 12/1975 | Broms et al. | 405/258 |
| 4,483,640 | 11/1984 | Berger et al. | 405/15 |
| 4,650,368 | 3/1987 | Bayer | 405/15 X |
| 4,655,637 | 4/1987 | Vignocchi | 405/15 X |
| 5,076,735 | 12/1991 | Hilfiker | 405/258 X |
| 5,368,410 | 11/1994 | Ferraiolo | 405/15 X |

FOREIGN PATENT DOCUMENTS

| | | | |
|---|---|---|---|
| 204207 | 11/1983 | Japan | 405/284 |
| 68431 | 4/1984 | Japan | 405/15 |
| 123608 | 7/1985 | Japan | 405/15 |
| 34118 | 2/1992 | Japan | 405/16 |
| 59710 | 3/1993 | Japan | 405/16 |
| 179629 | 7/1993 | Japan | 405/16 |

*Primary Examiner*—John A. Ricci
*Attorney, Agent, or Firm*—Gregory Friedlander

[57] ABSTRACT

An improved gabion system comprising at least one separator wall to partition the interior of the gabion wire mesh basket to form a chamber having an outer face and an insert or facing to fill the chamber. The facing may have an intermediate member extending through the mesh to disguise or cover the wire mesh of the outer face. The facing may serve as a surface for mounting solidifying facing materials as well as solid face covers. The facing provides support to the outer face and provides an aesthetically improved appearance to the outer face. The insert may also provide a support along the outer face for various purposes.

20 Claims, 7 Drawing Sheets

GABION SYSTEM

BACKGROUND OF THE INVENTION

This invention relates broadly to the art of Gabion Systems.

More particularly the invention relates to a Gabion System incorporating wire grid works forming inter connected baskets.

More particularly the invention relates to a series of gabion baskets having separator walls defining chambers which may be filled with flat elements to impart structure and improved appearance to the exterior walls of the Gabion baskets.

Gabion Systems are containers or cages filled with ballast. They may have dividers or baffles or partitions to separate the area to be filled with hard durable material or ballast. Usually these cages are interconnected to retain earth and control soil erosion and floods.

The common feature for most Gabion Systems is a basket filled with rocks. The basket serves to hold the rocks in place and the combination of the basket and rock serves as a means for preventing erosion or as a liner for various purposes.

Gabion Systems are substituted commonly for concrete facings and are superior in some respects because the Gabion System acts as a natural filter as opposed to a barrier. Gabion Systems may improve drainage and provide related benefits.

Gabions may be made of steel wire (of square, rectangular, hexagonal or other shaped mesh. Different types of wire include galvanized steel, PVC coated, galfan steel and stainless steel wire. The baskets may also be made of plastic.

The most common types of filler or ballast are crushed stone or gravel. Other materials are slag or broken concrete. The main property of ballast is that the material be of sufficient weight to act as ballast. Because of the great weight of the fill material or ballast, and the methods of dumping fill, the installer invariably deforms the gabion basket and creates unsightly and aesthetically displeasing appearances. In extreme cases this deformation can cause structural failure.

Gabion installation is typically labor intensive compared to certain concrete construction. The installer often puts in extensive labor to accommodate individual stones to reduce bulging and to maximize appearance. Even when labor is used in this fashion, the rock and wire look may be unacceptable.

Concrete facings in many situations provide a construction surface that may be useful. A major problem with concrete is the expense of this type of system versus a Gabion System as well as maintenance problems associated with the cracking and breaking of the concrete. Maintenance of such a system is also expensive and difficult. Gabion Systems are typically 40% less expensive than concrete walls and may be put in wet versus having to dry an area for concrete.

U.S. Pat. No. 5,076,735 Hilficker discloses a Gabion basket having panels joined at intervals disposed at an angle relative to one another and joined edge to edge to define baskets between panels. Large cast concrete facings which are bolted to the gabion basket are used to cover the remainder of the wall. Hilficker shows that the gabion rocks may be covered using a solid facing of the type present in pre-cast concrete barriers which does not otherwise improve the function of the traditional gabion basket covered. This barrier is put in place after the ballast is added to the baskets. Also, these barriers do not maintain the draining properties of the gabion system. U.S. Pat. No. 4,425,743 to Bartur shows a mantle of Gabions used with a water repellant sheet of plastic. U.S. Pat. No. 4,394,9242 Zaccheroni also teaches connecting diaphragms to the gabion's base. These interior partitions are to compartmentalize the gabion. The partitions reduce shifting of the ballast within the interior of the gabion basket. U.S. Pat. No. 4,904,124 to Egan reveals a Gabion made from a grid of rigid rods welded together and shaped to define the basket that may be in lattice work and provide inner partitions.

In each of these prior art patents, the interior compartments are filled with rocks or ballast such as dirt consistent with ancient gabion technology. These compartments are not filled with support systems, nor is an integral mechanism for improving the appearance of the gabion disclosed. The present invention serves to address the improvement of the gabion system without external concrete covers while providing support to the gabion basket at the front face while the basket is filled.

GENERAL DISCUSSION OF THE INVENTION

The present invention allows for a gabion system to be used with a decorative and functional element.

The present invention by strengthening the framework prior to filling with ballast eliminates much of the labor required to install gabions, prevents bulging, preserves alignment and provides an even appearance. In addition, the invention will, in its preferred embodiment, provide a selective appearance that hides the wire or plastic frame.

The present invention also allows for architects to select and design from a variety of shapes, colors and textures for uses and facades suitable to a particular job.

The invention uses a series of precast blocks to provide a partial or complete veneer or facing. The precast blocks are located between the front exposed face of the gabion basket and a separator wall. The separator wall is placed within the gabion basket and a few inches away from and parallel to the exposed face or facing wall of the gabion structure. This provides a separated area for ballast behind the separator wall. This outer wall is at least partially hidden by a cover attached to the facing blocks. The blocks are inserted and fitted according to the predesignated pattern or arrangement covering the exposed area. Once the blocks are secured, the gabion stone filling is added without as much concern with bulging and deforming of the exposed common protected faces.

Strengthening the face allows for a gabion system that is more quickly filled. Adjoining gabion cages support the sides of those adjacent cages. The end gabion cases may have side facings of the same type as the front facings.

The invention is designed to be easily applied. It may consist of precast concrete, plastic, wood or other suitable materials. The precast materials may be blocks of various shapes, colors, styles, textures, and the like to fit the mesh patterns of the gabion used by the installer. The blocks when inserted become an integral element of the gabion system.

It is therefore an object of this invention to provide a gabion system that addresses the structural and aesthetic appearance deficiencies of at least one face of gabion systems.

It is a further object to allow gabion usage in urban areas while enhancing gabion structures even in waterways and rural areas without additional cost.

A further object of the present invention is to describe a Gabion system in which part of the basket is separated from the remainder of the basket to act as a container for a filler means to provide an aesthetic or functional face distinguished in function from the ballast used in the remainder of the basket chamber.

A further object of the invention is to define a Gabion System having a facing means providing a decorative appearance and providing support to at least one face of the gabion basket.

A further object of the present invention is to provide a Gabion System that has at least one decorative face that may have substituted decorative elements for different settings.

A further object of the present invention system is to provide a Gabion System having a facing means to serve as a mounting for a facing cover for various functional purposes associated with the Gabion System.

These and other objects, advantages and features of the invention will become clear from a review of the detailed description that follows and the accompanying drawings.

DETAILED DISCUSSION OF THE PREFERRED EMBODIMENT(S)

Figure 1:
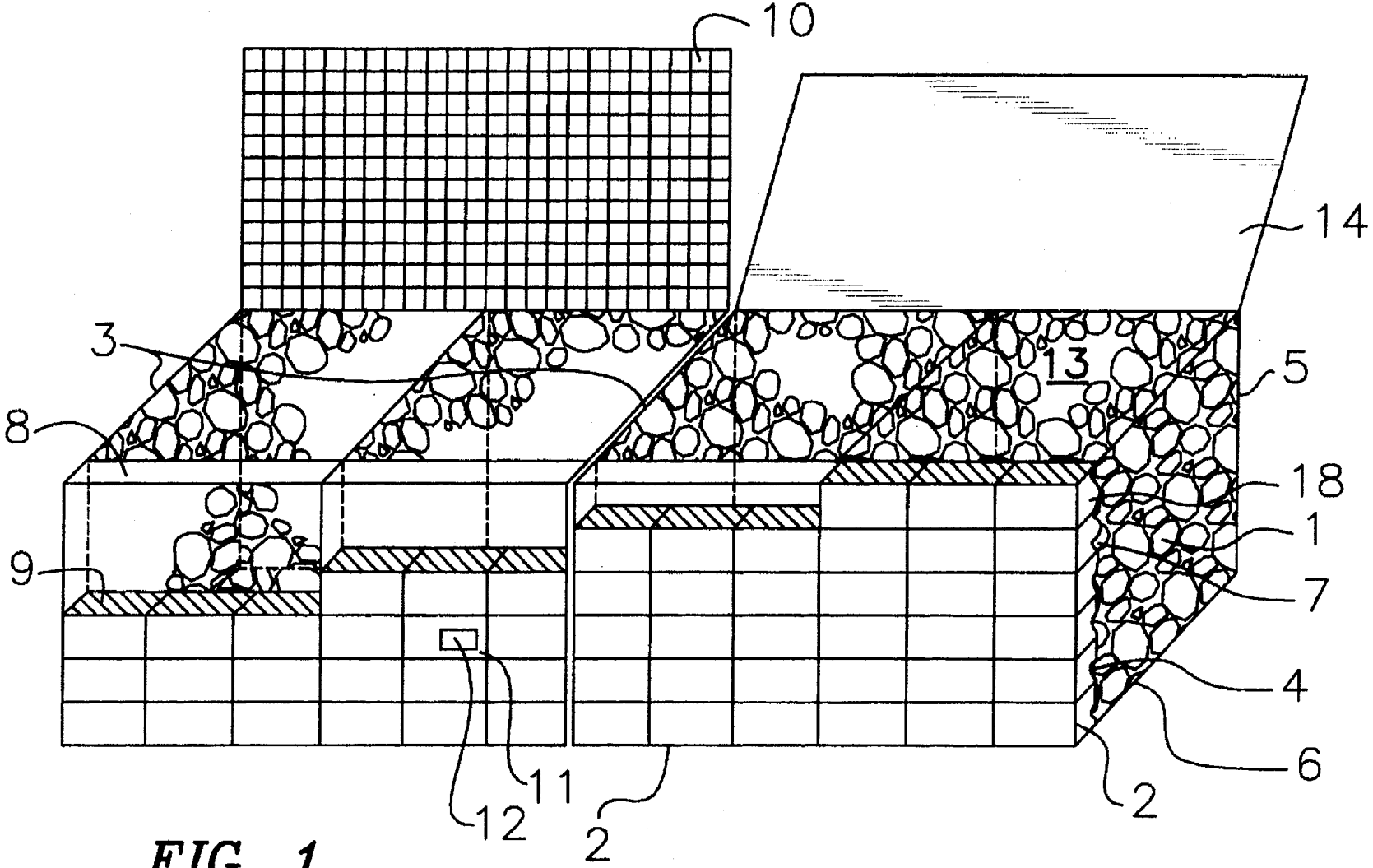
FIG. 1 is a perspective view of the preferred embodiment.

As can best be seen by reference to FIG. 1 the invention has a frame similar to those of existing Gabion systems, comprising a container means 1 for containing rocks. This container or basket means 1 is, in the preferred embodiment, a wire mesh basket 1 for containing ballast.

The mesh is preferably a regular wire mesh having a facing wall 2, a left side wall 3, a right side wall 4, a back wall 5 and a bottom wall 6. These walls together form the basket 1 for containing ballast similar to all gabion systems. As can be seen, the left wall of the basket may serve as the right wall for an adjoining basket and a right wall of one basket may serve as the left wall of an adjoining basket.

The basket 1 is modified by having a separator wall 7 installed parallel to the facing wall 2. The separator wall 7 forms a chamber 8 between the separator wall 7 and the facing wall 2. The chamber 8 formed between the separator wall 7 and the facing wall 2 may be divided into several separate chambers, although this is not true in the preferred embodiment. This chamber 8 serves as an attachment means for holding the facing means 9 in functional contact with the facing wall 2 and as a separator means 7 or separating wall 7 for separating the chamber 8 from the remainder of the basket interior 13.

The facing means 9 for providing support and aesthetic appeal to the container means 1 consists of a flat element 11 fitting within the chamber 8 in its most simple form.

This flat element 11 fits functionally within the chamber 8. The functions are to provide an aesthetic appearance to the exterior of the facing wall 2 and to provide a structurally enhanced gabion facing wall 2.

Figure 6:
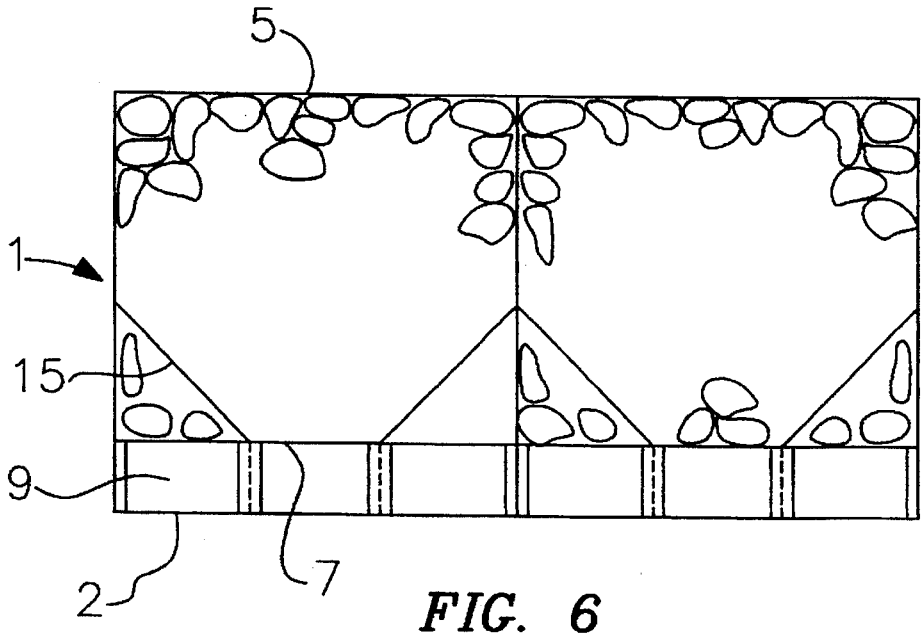
FIG. 6 is a top cross sectional view of the facing element of FIG. 2.

One function of the facing means 9 is to provide support to the gabion basket 1 to prevent bulging of the face wall 1. To enhance this function tension wires 15 shown in FIG. 6 may run from the facing wall 2, facing element 9 or separator wall 7 back to the side walls 3 and 4, top wall 14 or bottom wall 6 or the back wall 5.

In a typical gabion basket 1, a top wall 14 is added after the rocks fill the gabion basket 13.

Figure 2:
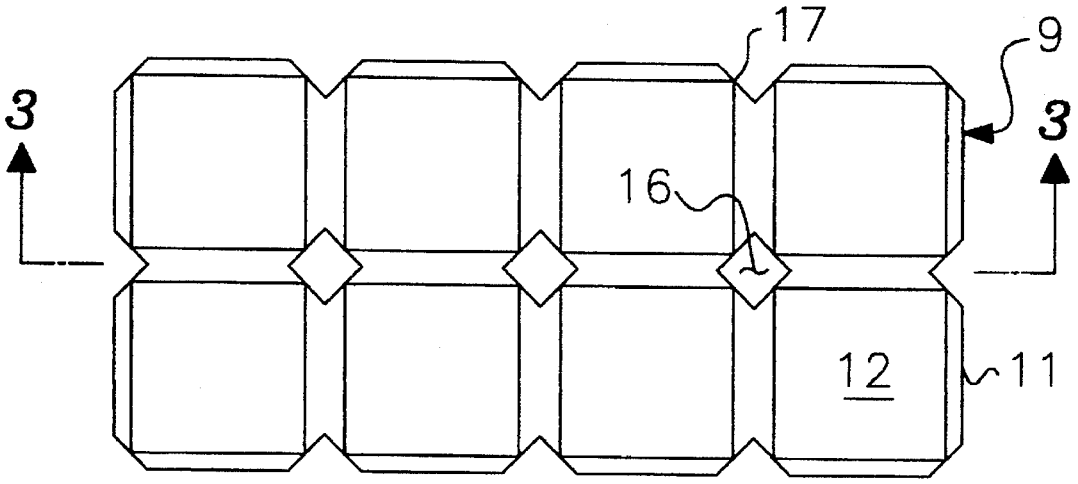
FIG. 2 is a top view, looking down on the facing element used in the preferred embodiment.
Figure 3:
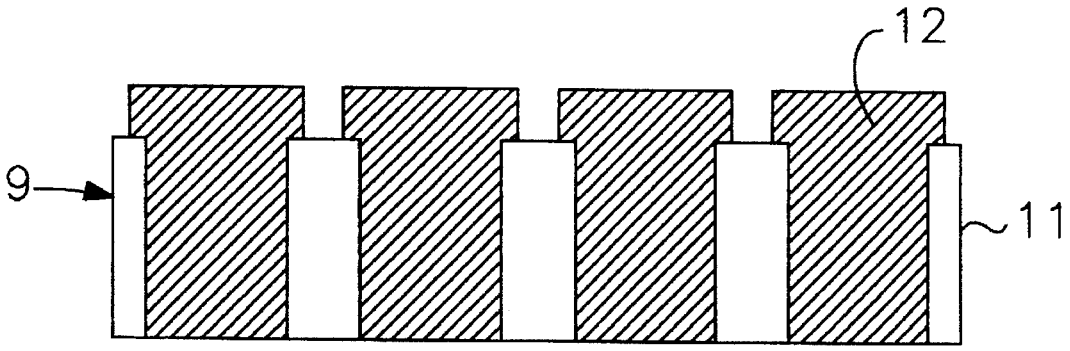
FIG. 3 is a cross sectional view of the facing element of FIG. 2 through the B—B axis.
Figure 4:
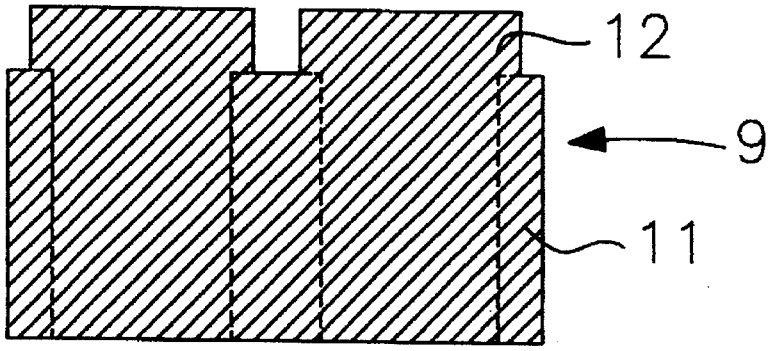
FIG. 4 is an alternate cross sectional view of the facing element of FIG. 2 through the A—A axis.

As can best be seen by reference to FIGS. 2 through 4, the gabion facing means 9 comprises several unique features in the preferred embodiment. Since each face of the gabion basket 1 is made of wire, a series of openings 10 are formed in the gabion basket mesh shown in FIG. 1. In the preferred embodiment, the facing means 9 comprises a flat element 11 that substantially fills the chamber 8. The facing means 9 further comprises a series of intermediate members 12 designed to fit through the openings 10 formed by the crossing wire of the basket 1.

The intermediate elements 12 fit through the openings 10 and hide the wires in the channels between these intermediate members 12. These intermediate members 12 and flat elements 11 may be molded of a single block. Since the facing means 9 is not poured in place, it may be replaced if damaged more easily than poured concrete and it does not require a dry surface for application. Similarly, because they are only used on a single gabion basket, they may be inserted before placement of the basket 1 without adding excessive weight to individual baskets 1.

Figure 5:
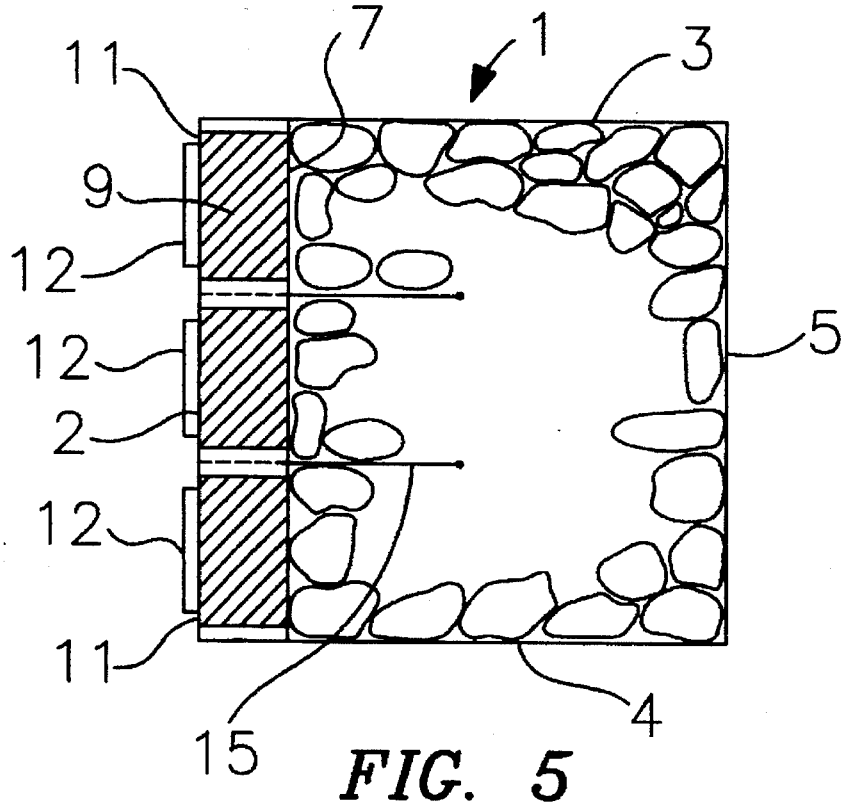
FIG. 5 is a side cross sectional view of the gabion element shown in FIG. 1.

The intermediate elements 12 may have mountings (not shown) to use for attaching a face cover 19 to enclose the basket wires completely. Other mountings (not shown) may be added to the flat elements 11 to allow for attachment to the tension wires 15 shown in FIGS. 5 and 6. In the preferred embodiment, the intermediate element 12 is formed as an integral part of the flat element 11 so that the two are cast as a unit.

An additional improvement possible using the present invention is to provide a face cover 19 that would fit onto intermediate members 12 to completely enclose at least part of the wire. The facing block 9 may have embedded mountings on the intermediate members 12 to attach the face cover 19. This face cover 19 adds an additional facade to the facing wall 2. This might be useful where, for example, a walking surface was desired or where the surface was planned with a different material than the supporting flat elements 11 and intermediate elements 12.

The characteristics of the intermediate members 12, face covers 19 and flat elements 11, may be varied for providing various benefits such as support, cleaning, fertilizing, shock absorption, noise reduction, etc. as described in greater detail below.

Another feature of the gabion facing elements described in the preferred embodiment is that the flat elements 11 define openings 16 within the flat element 11 itself and notches 17 at the edges of the flat element 11 to allowing for drainage from the interior 13 of the gabion basket 1. Where the tolerance is sufficiently close, the notches 17 and openings 16 may extend to the corners of the intermediate members 12 so that drainage would be through these spaces cut between the intermediate members 12 and the enclosed wire mesh.

The gabion system described herein may have the facing wall 2 or separator wall 7 attached by way of spiral binders 18 to the left side wall 3, right side wall 4, and bottom wall 6. By removing these binders 18 holding the facing wall 2, the facing elements 9 may be serviced or replaced.

It can be seen from this description that the invention may be practiced having specialized gabion baskets 1 only on the outermost layer of a gabion system. It can be seen that although a typical gabion basket 1 fully encloses the ballast, the present system requires only a basket 1 with at least 3 sides for containing ballast having a separator means comprising at least one separator wall 7 insertable between and parallel to at least one facing means 9 which is preferably a permeable wall made up of substantially flat elements 11. Openings 16 allow for water flow through the facing means and notches 17 around the perimeter of the flat elements 11 allow drainage between the flat elements 11.

Typically, these flat elements 11 comprise a block of suitable material such as double wall-concrete block of dimensions to allow it to be fit within the chamber 8 formed by the facing wall 2 and separator wall elements 7. A variety of materials may be used for the facing means 9 such as concrete, plastic, wood, brick, tiles, etc. Further, the flat element 11, intermediate members 12 and face covers 19 may be made of different materials suitable to the particular function or aesthetics of the element in question. It is possible to take advantage of any materials, such as wood strips, to create the desired appearance and strength characteristics of the flat elements 11, intermediate members 12 and face covers 19.

The intermediate members 12 may be replaced partially with a casting compound such as glue, concrete, asphalt or other pasting or solidifying compound in order to provide a face cover 19 or to seal the face cover 19 to the flat elements 11.

The facing means 9 may be comprised of mounting material such as double wall concrete block fitting within the double wire chamber 8 having measurements of, for example, 6 inches by 12 inches. The facing means 9 could also be a solid slab of concrete, plastic, wood or other suitable material of the same size as the portion of the face covered, typically 3 feet by 3 feet for a standard gabion basket that has faces measuring 3 feet by 3 feet. Since some expansion and contraction is present, to prevent cracking of the facing means 9 the use of several separate elements 11 or elements 11 joined with a flexible bonding material such as asphalt is desirable.

A typical size for the facing elements 11 is approximately 6"×12"×2&¾ inches. The 2& ¾ inch measurements being the thickness. The 6 inch by 12 inch blocks may be replaced with a solid slab of 3 feet by 3 feet for a standard gabion basket 1 if cracking is not a problem with the material used. The thickness dimension is typically composed of a flat element 11 having a thickness of 2&¾ inches and an intermediate member 12 having a thickness of an additional ¾ inch for a total thickness of 3&½ inches where an intermediate member 12 is used. Where a face cover 19 is used, the thickness of the face cover 19 is determined by questions of cost and function.

Other modifications of the face cover 19 may be to include holes to allow drainage in the fashion described above for the flat element 11. Smaller tiles may be used for greater flexibility. Similarly to maintain greater strength and reduce bulging, the face covers 19 may be joined by expandable joint compounds such as asphalt.

An alternate embodiment provides that the attachment means 7 is accomplished by having the face cover 19 firmly hold a suitable facing element 11 so that the facing wall 2 is encased between the face cover 19 and the flat element 11. The space between the intermediate member 12 and flat element 11 and face covers 19 may be filled with functional materials, such as asphalt or joint compounds to cushion the interface of the blocks, protect the wire mesh or provide fertilizer or other materials that are desirable to be slowly released from the gabion system. An example would be where a layer of asphalt is applied to cover the wire mesh of the facing wall 2 before the time that the face cover 19 was put in place. Where face covers 19 are used, the intermediate members 12 may be replaced with bolts or cement which serve the same purpose as the intermediate members 12.

Although described as a flat element 11 to correspond to the typical shape of the facing wall 2, the flat element 11, intermediate member 12 and face covers 19 may be textured on either side. An example of where this may be appropriate would be where the flat element 11 defines an irregular surface facing the separator wall 7 to absorb stresses to which it may be subjected as the gabion basket is filled with ballast or where the face covers 19 are irregular to provide for greater traction or to absorb exterior stresses where appropriate.

Figure 7:
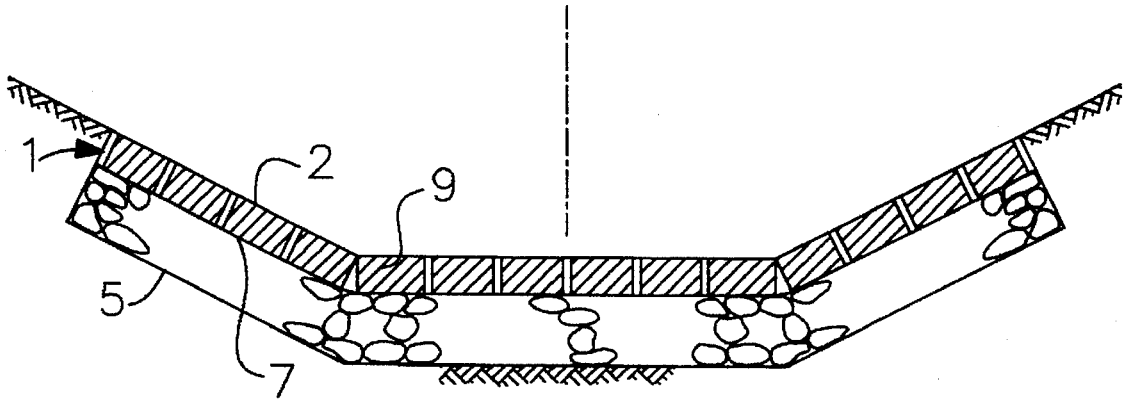
FIG. 7 is a cross sectional view of a gabion system using the technology involved.
Figure 8:
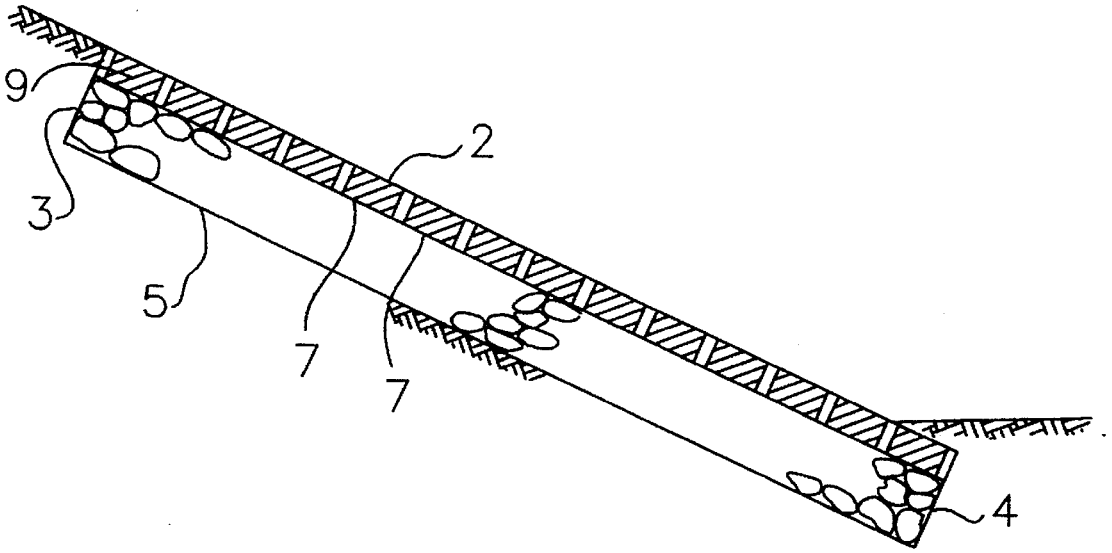
FIG. 8 is a cross sectional view of an alternate gabion system using the technology described in the patent.

FIG. 7 illustrates how the invention would appear when applied to a gabion channel lining system. FIG. 8 shows how the invention would appear when applied to a gabion slope protection system.

Figure 9:
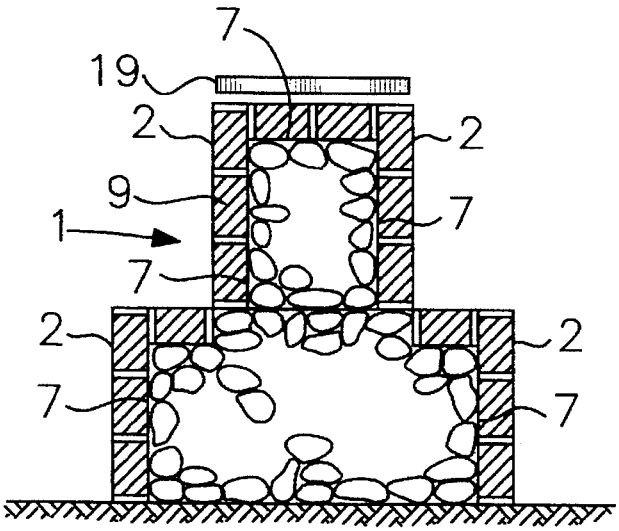
FIG. 9 is a cross sectional view of an alternate gabion system using the technology involved.

FIG. 9 shows how the system could be applied to a gabion wall. This view shows how two or more separate facing walls 2 may be present on a single gabion basket.

Figure 10:
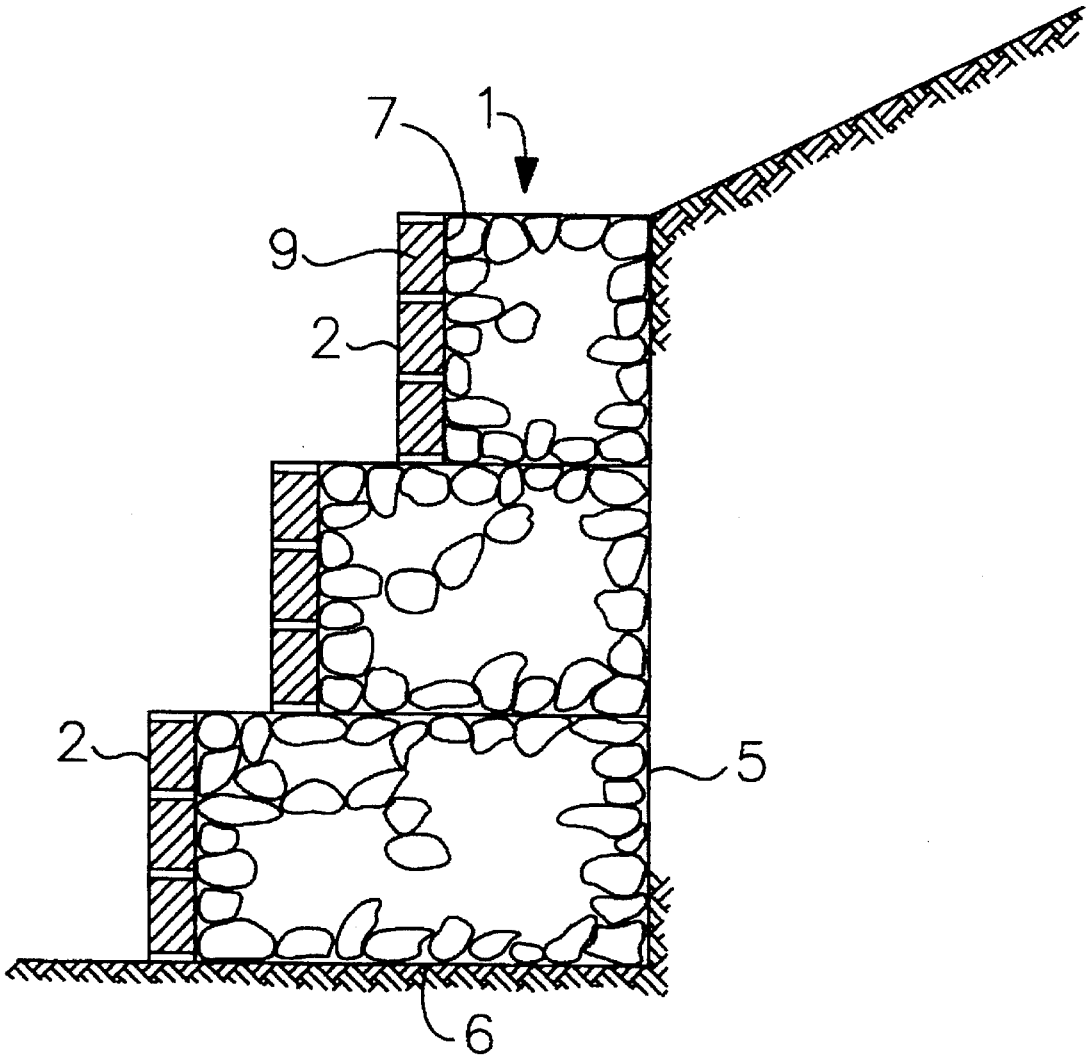
FIG. 10 is a cross sectional view of an alternate gabion system using the technology described in the patent.
Figure 11:
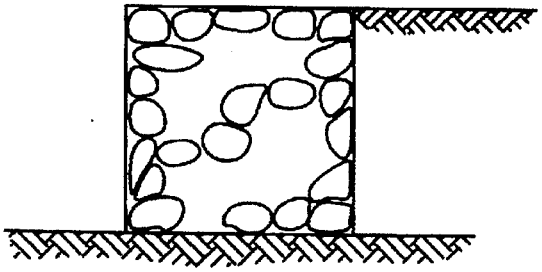
FIG. 11 (PRIOR ART)
FIG. 11 is a cross sectional view of a gabion system using the technology pre-dating the patent technology.
Figure 12:
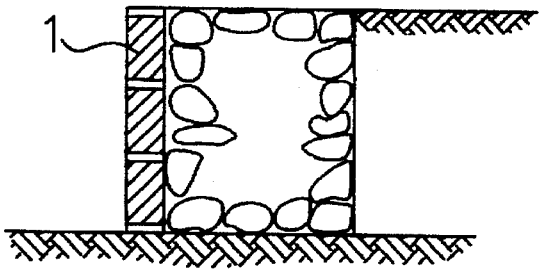
FIG. 12 is a cross sectional view of an alternate gabion system using the technology involved.
Figure 13:
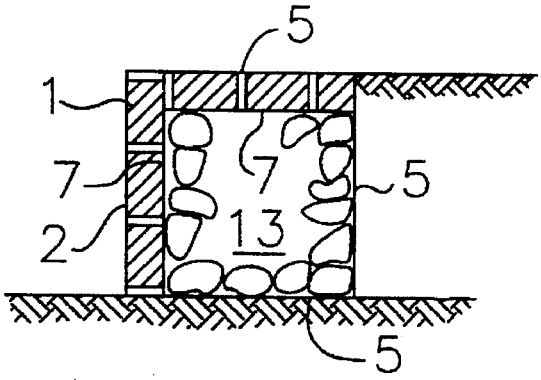
FIG. 13 is a cross sectional view of an alternate gabion system using the technology described in the patent.
Figure 14:
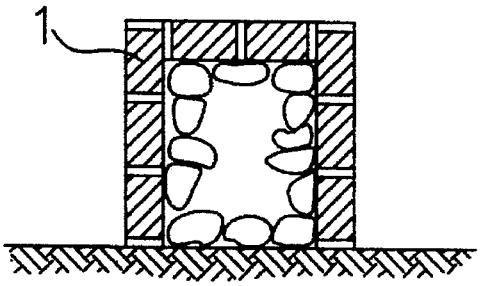
FIG. 14 is a cross sectional view of an alternate gabion system using the technology described in the patent.

FIG. 10 shows a gabion retaining wall using the present invention.

A system is therefore described for the placement of gabion walls having a facing means 9 comprising the steps of:

1. Determining the requirements of the facing means 9 for structural support and surface features such as appearance and texture;
2. assembling a wire mesh basket having an array defined by the wire mesh of the gabion basket facing wall and defining an interior space;
3. Casting flat elements of sufficient dimensions to meet the requirements of structural support determined previously;
4. Casting intermediate members to join with the flat elements and functionally fit thought the array of the wire mesh and with a texture as determined previously;
5. placing the flat elements in place within the wire mesh basket so that the intermediate members fit functionally through the array of the wire mesh of the gabion basket facing wall to allow for support and drainage;

6. providing tension in wires between the flat elements and the wire mesh basket to provide desirable tension;
7. securing a separator wall between the flat elements and the interior space of the wire mesh basket;
8. filling the interior space with ballast;
9. applying a face cover to the intermediate members.

As can be seen from the detailed description, the steps 3 & 4 may be combined if a single unitary body incorporating both the flat element 11 and intermediate member 12 is desirable. Similarly, the separator wall 7 may be put in place before placing the flat elements. Where desirable, the separator wall 7 or tension wires 15 may be eliminated completely.

The additional step of applying casting compounds such as concrete, asphalt or other joint compounds to functionally cushion or seal the various elements together may be added consistent with the preceding disclosure and process.

From the detailed description, it is apparent that the present invention enables the attainment of the objects initially set forth herein. It should be understood, however, that the invention is not intended to be limited to the specifics of the illustrated embodiments and this detailed description should be interpreted as an exemplary model as opposed to a limiting model.

I claim:

1. A gabion system comprising:

(A) a container means having a facing wall for containing rocks comprising a mesh; and (B) at least one facing means contacting functionally at least a portion of the mesh and wherein the at least one facing means further comprises an attachment means for holding the at least one facing means in operable position to support the mesh and wherein the container means further comprises a basket means for containing ballast and wherein the attachment means further comprises a separator means for creating at least one chamber within the basket means and wherein the at least one facing means further comprises at least one flat element fitting within the at least one chamber so that the at least one flat element is held in functional contact with the mesh.

2. The gabion system of claim 1 wherein the facing wall further comprises a left and right side, and wherein the basket means further comprises a left side wall having a front and back attached on the front to the left side of the facing wall and a right side wall having a front and back attached on the front to the right side of the facing wall thereby defining a basket with at least 3 sides for containing ballast and wherein the separator means comprises at least one separator wall insertable between and parallel to the facing wall between the facing wall and the back of the left and right side walls to form the at least one chamber, said chamber comprising the facing wall, the left wall in front of the separator wall, the right wall in front of the separator wall and the separator wall.

3. The gabion system of claim 2 wherein the flat element has dimensions to allow it to be fit functionally with the chamber formed by the facing wall and the separator wall.

4. The system of claim 1 wherein the attachment means comprises a casting compound applied to the at least one facing means and extending to the mesh.

5. The system of claim 4 wherein the casting compound extends through the mesh and wherein said casting compound contacts the at least one facing means.

6. A Gabion system comprising:

(a) a container means having a facing wall for containing rocks wherein the facing wall comprises a layer of mesh and (b) a facing means contacting functionally at least a portion of the mesh and wherein the mesh defines at least one first opening and at least one adjacent opening and wherein the facing means further comprises an intermediate means for hiding at least a portion of the mesh and wherein the intermediate means comprises at least one first intermediate member fitting through the at least one first opening and at least one second intermediate member fitting through at least one adjacent opening so as to disguise the mesh between the at least one first intermediate member and at least one second intermediate member by hiding a portion of the mesh.

7. The gabion system of claim 6 wherein the mesh comprises a plurality of openings and wherein the intermediate means further comprises a plurality of intermediate members fitting functionally within the plurality of openings to disguise the mesh.

8. The gabion system of claim 7 wherein the mesh openings are further defined by the mesh as having a regular shape and wherein the at least one first intermediate member and at least one second intermediate members have a regular shape functionally corresponding to the shape of the mesh openings to fit through the openings

9. A Gabion system comprising:

(a) a container means having a facing wall for containing rocks wherein the facing wall comprises a layer of mesh and (b) a facing means contacting functionally at least a portion of the mesh and wherein the mesh defines at least one opening and wherein the facing means further comprises at least one facing block within the container adjacent to the facing wall and an intermediate means attached to the at least one facing block for hiding at least a portion of the mesh and wherein the intermediate means comprises at least one intermediate member fitting through the at least one opening so as to disguise the mesh by hiding a portion of the mesh and further comprising at least one face cover functionally attached to the at least one intermediate member so as to cover at least a portion of the mesh between the facing block and the at least one face cover

10. The gabion system of claim 9 wherein the at least one intermediate member further comprises a securing means for securing the face cover to the at least one facing block.

11. The gabion system of claim 10 where the at least one intermediate member comprises a casting compound.

12. The gabion system of claim 10 where the at least one intermediate member comprises a mechanical joining means for joining the at least one face cover to the at least one facing block.

13. The gabion system of claim 12 wherein the mechanical joining means comprises a bolt having a first end and a second end and wherein the first end of the bolt is embedded in the at least one face cover and second end of the bolt is embedded in the at least one facing block.

14. A method for the placement of gabion walls having facing walls comprising the steps of:

a. Assembling a wire mesh basket having an array defined by the wire mesh of the wire mesh basket facing walls wherein the facing walls are the most exterior wire mesh walls of the wire mesh basket and wherein the wire mesh basket defines an interior space;

b. Casting a plurality of flat elements to fit against the facing walls;

c. placing the flat elements within the wire mesh basket; and d. filling the interior space with ballast.

15. The method of claim 14 further comprising the steps of:

e. casting intermediate members;

f. joining the flat elements to the intermediate members so that the intermediate members may functionally fit through the array of the wire mesh to allow for support and drainage.

16. The method of claim 12 wherein at least one face cover is applied to at least one of the plurality of intermediate members.

17. The method of claim 16 further comprising the step of applying a casting compound between the at least one face cover and the wire mesh of the facing walls.

18. The method of claim 17 further comprising the step of attaching at least one face cover to the casting compound against the wire mesh opposite the wire mesh from the flat elements.

19. The method of claim 18 further comprising the steps of inserting a separator wall opposite the flat elements from the facing wall and attaching tensioning wire means between the flat elements and the wire mesh basket opposite the separator wall from the facing wall for providing tension between the flat elements and the remainder of the basket.

20. The method of claim 14 further comprising the step of joining the plurality of flat elements together using a casting compound.

* * * * *